US009643099B1

(12) United States Patent
Mamolo, Sr.

(10) Patent No.: US 9,643,099 B1
(45) Date of Patent: May 9, 2017

(54) BALLOON WITH INTEGRATED SEALING

(71) Applicant: Nicolas A Mamolo, Sr., Westwego, LA (US)

(72) Inventor: Nicolas A Mamolo, Sr., Westwego, LA (US)

( * ) Notice: Subject to any disclaimer, the term of this patent is extended or adjusted under 35 U.S.C. 154(b) by 0 days.

(21) Appl. No.: 14/828,917

(22) Filed: Aug. 18, 2015

(51) Int. Cl.
*A63H 27/10* (2006.01)

(52) U.S. Cl.
CPC ..... *A63H 27/10* (2013.01)

(58) Field of Classification Search
USPC ..... 446/220, 222; 383/3; 428/40.1, 41.8
See application file for complete search history.

(56) References Cited

U.S. PATENT DOCUMENTS 3,108,396 A * 10/1963 Dorman ..... A63H 27/10 383/7
5,295,892 A * 3/1994 Felton ..... A63H 27/10 446/220
5,776,291 A * 7/1998 Lang ..... A63H 27/10 156/290
5,860,441 A * 1/1999 Garcia ..... A63H 27/10 137/15.18
6,254,545 B1 * 7/2001 Stasz ..... A61B 5/0816 600/529
6,506,465 B1 * 1/2003 Sloot ..... G09F 23/00 401/88
6,527,615 B1 * 3/2003 Boehler ..... A63H 27/10 24/30.5 R
8,727,829 B2 * 5/2014 Halliburton ..... A63H 27/10 446/220
2005/0176339 A1 * 8/2005 Cuisinier ..... A63H 27/10 446/220
2011/0151744 A1 * 6/2011 Archer ..... A63H 27/10 446/222
2014/0030452 A1 * 1/2014 Warner ..... A63H 27/10 428/34.1
2014/0273718 A1 * 9/2014 Harris ..... A63H 27/10 446/222

* cited by examiner

*Primary Examiner* — Kurt Fernstrom
(74) *Attorney, Agent, or Firm* — Gulf Coast Intellectual Property Group

(57) ABSTRACT

A balloon that is operable to facilitate a sealing thereof subsequent being filled with a substance wherein the sealing does not require a knot or external clamp. The balloon includes a body having a contiguous wall being formed in a desired shape. Proximate the first end of the body a neck is contiguously formed. The neck includes a hollow passage and an opening so as to facilitate the filling of the interior volume of the balloon. Circumferentially disposed in the neck proximate the opening is an adhesive layer. Superposed the adhesive layer is a protective layer that is rectangular in shape, The protective layer further includes a first tab and a second tab that extends outward from the opening and functions to provide an interface to facilitate the removal of the protective layer so a user can utilize the adhesive layer to seal the opening.

8 Claims, 1 Drawing Sheet

BALLOON WITH INTEGRATED SEALING

FIELD OF THE INVENTION

The present invention relates to novelty devices, more specifically but not by way of limitation a balloon that is operable to be filled with a liquid such as but not limited to water that includes a neck region having sealing mechanism operable to seal the cavity of the balloon.

BACKGROUND

Novelty devices and toys proliferate the market place and are sold to various demographics to fill a particular need. Whether it's a practical joke device or a game/toy, the market in the United States for these products is billions of dollars per year. One toy/novelty item that is very popular is the balloon. Balloons are utilized for numerous different occasions such as but not limited to decorations for a birthday party or other similar event. Many people will implement a balloon drop as part of a special occasion.

While balloons have traditional uses such as the aforementioned, they are further utilized to play various games. One favorite activity of millions of youth is to fill balloons with water and either surprise someone as a practical joke or engage in a game where players attempt to hit other players with a water-filled balloon.

One issue with current balloons is the technique in which they must be sealed. Conventional balloons typically have an extended neck area that is stretched and then tied into a knot so as to seal and/or isolate the cavity that has been filled with the desired substance. The tying of the knot in the neck area has proven to be challenging for many people. Often the neck material is difficult to grasp and has further proven to break easily during the process of tying a knot.

Accordingly, there is a need for balloon that includes a neck area that includes a sealing mechanism that eliminates the need for a user to tie a knot in the neck area so as to seal the filled cavity of the balloon.

SUMMARY OF THE INVENTION

It is the object of the present invention to provide a balloon having an outer wall forming a cavity that further includes a neck region wherein the neck region is includes an integral sealing mechanism.

Another object of the present invention is to provide a balloon being constructed of a suitable expandable material such as but not limited to latex rubber wherein the sealing mechanism is proximate the opening of the neck.

A further object of the present invention is to provide a balloon that is constructed so as to receive and store a liquid therein wherein the sealing mechanism is circumferentially disposed proximate the opening of the neck.

An additional object of the present invention is to provide a balloon that is operable to receive a liquid within a cavity and subsequently isolate the cavity wherein the sealing mechanism circumferentially disposed within the neck region is manufactured from a pressure sensitive adhesive.

Still another object of the present invention is to provide a balloon operable to receive a fluid within its cavity wherein the sealing mechanism further includes a protective layer superposed thereon.

Yet a further object of the present invention is to provide a balloon operable to receive a liquid therein wherein the protective layer further includes an engagement tab extending beyond the perimeter of the opening of the neck.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 2:
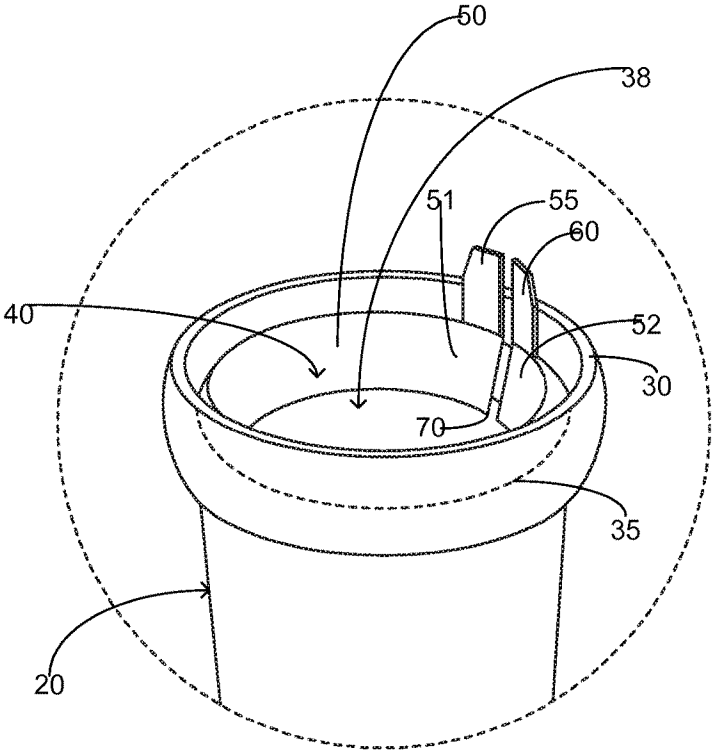
FIG. 2 is a detailed view of the opening of the neck region of the present invention.

Referring now to the drawings submitted herewith, wherein various elements depicted therein are not necessarily drawn to scale and wherein through the views and figures like elements are referenced with identical reference numerals, there is illustrated a balloon 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 1:
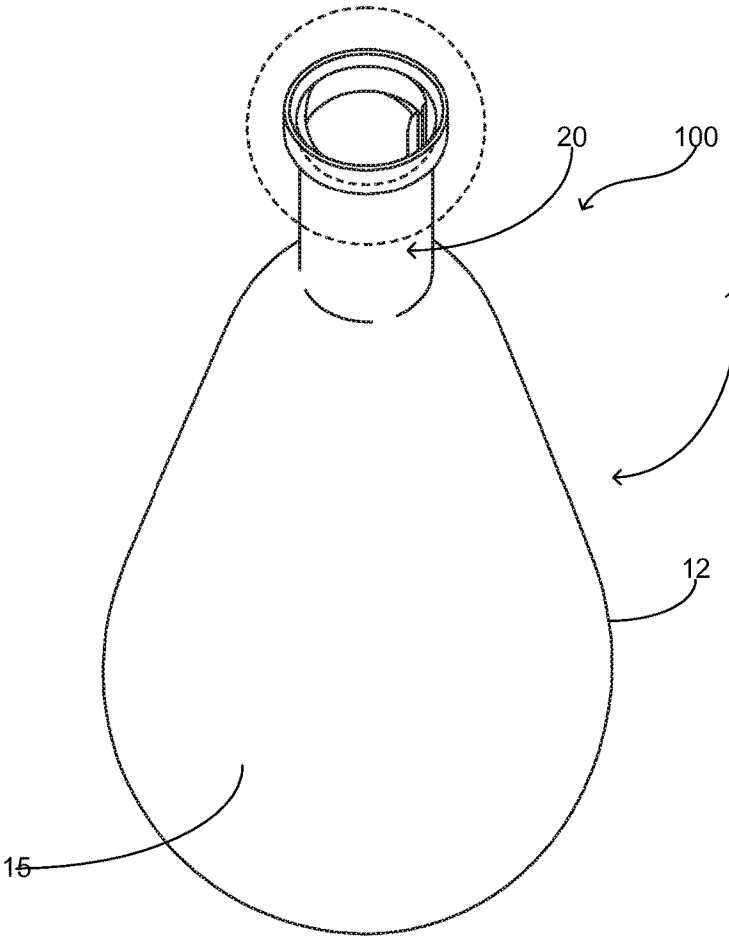
FIG. 1 is a perspective view of a preferred embodiment of the present invention.

Referring now in particular to FIG. 1, the balloon 100 further includes body 10 that is manufactured from a suitable expandable material such as but not limited to latex rubber. The body 10 includes wall 12 and is contiguously formed utilizing suitable manufacturing techniques to form a desired shape having a interior volume 15 operable to receive a gas or liquid therein. The body 10 includes first end 8 and second end 9. It is contemplated within the scope of the present invention that the body 10 could be formed in numerous different sizes and shapes.

Contiguously formed with the body 10 proximate first end 8 is neck 20. The neck 20 provides a desired shape enabling a user to engage and introduce a fluid or gas into the interior volume 15 of the body 10. The neck 20 is generally cylindrical in shape and includes a hollow passage 38 providing a means to couple the opening 40 with interior volume 15. Opening 40 includes rim 30, which functions to form the shape thereof.

Referring in particular to FIG. 2, a detailed view of the opening 40 is illustrated therein. The opening 40 includes an adhesive layer 35 circumferentially disposed therearound. While no particular type of adhesive is required, good results have been achieved by utilizing a pressure sensitive adhesive for the adhesive layer 35. Superposed on the adhesive layer 35 is protective layer 50. The protective layer 50 is manufactured from a suitable flexible material such as but not limited to paper. The protective layer 50 functions to ensure that the adhesive layer 35 is not engaged to seal the opening 40 until a user is ready to utilize the balloon 100. The protective layer 50 is rectangular in shape and includes a first end 51 and second end 52. A void 70 is intermediate first end 51 and second end 52. Extending upward from first end 51 is tab 55. Tab 55 is contiguously formed with protective layer 50. Tab 55 provides a means for a user to engage and subsequently remove the protective layer 50 ensuing the filling of the cavity with a desired substance. Tab 55 extends beyond rim 30 to facilitate the grasping thereof. While no particular length is required for the tab 55, it is contemplated within the scope of the present invention that the tab 55 extends beyond the rim 30 approximately one-quarter inch.

Protective layer 50 further includes second tab 60 contiguously formed with the second end 52. Second tab 60 is adjacent to tab 55 with void 70 intermediate thereto. Second tab 60 is positioned similarly to tab 55 with void 70 providing the necessary space for a user to engage either the tab 55 or second tab 60 to remove the protective layer 50. While tab 55 and second tab 60 are illustrated and described herein, it is contemplated within the scope of the present invention that the protective layer 50 could be constructed having only one tab so as to facilitate the removal thereof. Ensuing the removal of the protective layer 50 the wall 12 is pressed together proximate the neck 20 so as to engage the adhesive layer 35. The activation of the adhesive layer 35 functions to seal the opening 40 so as to restrict the egression of the substance disposed within the interior volume 15.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A balloon comprising:

a body, said body including a wall, said wall being formed in a contiguous shape, said wall of said body forming an interior volume, said body being manufactured from an expandable material, said body further including a neck, said neck being contiguously formed with said body, said neck having an opening;

an adhesive layer, said adhesive layer being circumferentially disposed within said neck, said adhesive layer being proximate said opening, wherein said adhesive layer is manufactured from a pressure sensitive adhesive;

a protective layer, said protective layer being superposed said adhesive layer, said protective layer being manufactured from a flexible material, said protective layer being removable, wherein said protective layer is rectangular in shape having a first end and a second end;

at least one tab, said at least one tab being contiguously formed with said protective layer, said at least one tab extending outward from said opening;

a void, said void being intermediate said first end and said second end of said protective layer;

wherein said adhesive layer is operable to seal the opening subsequent the interior volume being filled with a desired substance.

2. A balloon that is operable to facilitate a seal proximate the opening thereof subsequent being filled with a substance comprising:

a body, said body including a wall, said wall being formed in a contiguous shape, said wall of said body forming an interior volume, said body being manufactured from an expandable material, said body further including a neck, said neck being contiguously formed with said body, said neck being cylindrical in shape and further including a hollow passage therethrough, said neck having an opening;

an adhesive layer, said adhesive layer being circumferentially disposed within said neck, said adhesive layer being proximate said opening;

a protective layer, said protective layer being superposed said adhesive layer, said protective layer being rectangular in shape, said protective layer having a first end and a second end, said protective layer being manufactured from a flexible material, said protective layer being removable; and a void, said void being intermediate said first end and said second end of said protective layer.

3. The balloon as recited in claim 2, and further including a first tab, said first tab being contiguously formed with said first end of said protective layer, said first tab extending outward from said opening.

4. The balloon as recited in claim 3, and further including a second tab, said second tab being contiguously formed with said second end of said protective layer, said second tab extending outward from said opening.

5. The balloon as recited in claim 4, wherein said first tab and said second tab extend outward from said opening one quarter inch.

6. A balloon that is operable to facilitate a seal proximate the opening thereof without the need of a knot or other external device comprising:

a body, said body including a wall, said wall being formed in a contiguous shape, said wall of said body forming an interior volume, said body being manufactured from an expandable material, said body further including a neck, said neck being contiguously formed with said body, said neck being cylindrical in shape and further including a hollow passage therethrough, said neck having an opening;

an adhesive layer, said adhesive layer being circumferentially disposed within said neck, said adhesive layer being proximate said opening, said opening being defined by a rim;

a protective layer, said protective layer being superposed said adhesive layer, said protective layer being rectangular in shape, said protective layer having a first end and a second end, said protective layer being manufactured from a flexible material, said protective layer being removable;

a void, said void being intermediate said first end and said second end of said protective layer;

a first tab, said first tab being contiguously formed with said first end of said protective layer, said first tab extending outward from said opening beyond said rim.

7. The balloon as recited in claim 6, and further including a second tab, said second tab being contiguously formed with said second end of said protective layer, said second tab extending outward from said opening beyond said rim.

8. The balloon as recited in claim 7, wherein said adhesive layer is a pressure sensitive adhesive.

* * * * *